US006082143A

United States Patent [19]

Noonkester et al.

[11] Patent Number: 6,082,143

[45] Date of Patent: Jul. 4, 2000

[54] CIRCULAR KNITTING MACHINE

[75] Inventors: George Stephen Noonkester, King; James Moore Schenck, Winston-Salem, both of N.C.

[73] Assignee: Sara Lee Corporation, Winston-Salem, N.C.

[21] Appl. No.: 08/911,296

[22] Filed: Aug. 14, 1997

[51] Int. Cl.[7] ..... D04B 15/88

[52] U.S. Cl. ..... 66/151; 66/147

[58] Field of Search ..... 66/8, 125 R, 132 R, 66/132 T, 146, 149 R, 150, 151, 152, 153; 242/981, 419, 419.8, 419.9

[56] References Cited

U.S. PATENT DOCUMENTS

| | | | |
|---|---|---|---|
| 3,521,466 | 7/1970 | Tannert | 66/153 |
| 4,671,083 | 6/1987 | Sawazaki et al. | 66/151 |
| 4,879,886 | 11/1989 | Okada et al. | 66/151 |
| 5,157,949 | 10/1992 | Sawazaki et al. | 66/151 |
| 5,249,439 | 10/1993 | Fucik et al. | 66/153 |
| 5,381,676 | 1/1995 | Shibata et al. | 66/149 R |
| 5,457,967 | 10/1995 | Scherzinger | 66/151 |
| 5,575,162 | 11/1996 | Gray et al. | 66/151 |
| 5,649,435 | 7/1997 | Bryant | 66/8 |

*Primary Examiner*—Larry Worrell
*Attorney, Agent, or Firm*—Rhodes & Mason, PLLC

[57] ABSTRACT

A circular knitting machine. The apparatus includes a generally conventional circular knitting element for forming a tubular knit fabric. A tension-controlled roll take-up assembly is located downstream from the circular knitting element for receiving the tubular knit fabric and forming a fabric roll from the tubular knit fabric while, at the same time, maintaining substantially constant tension on the tubular knit fabric being formed by the circular knitting element. This allows very large fabric rolls to be formed. In the preferred embodiment, the circular knitting machine includes a tension-controlled umbrella storage feed mounting ring adjacent to the circular knitting element for supplying a plurality of yarn ends to the circular knitting element for forming the tubular knitted fabric. The umbrella storage feed mounting ring permits an operator to attend to most machine functions without the need for a ladder or catwalk. In addition, the location of the tension control elements along the perimeter of the umbrella storage feed mounting ring provides an additional yarn reservoir which helps prevent fabric defects by providing additional time to stop the machine before, for example, a broken end of yarn enters the machine.

28 Claims, 3 Drawing Sheets

CIRCULAR KNITTING MACHINE

BACKGROUND OF THE INVENTION (1) Field of the Invention

The present invention relates generally to circular knitting machines and, more particularly, to a circular knitting machine adapted to knit and take-up a very large roll of fabric.

(2) Description of the Prior Art

Historically, circular knitting machines have employed take-up rolls for receiving knitted fabric which are capable of holding between about 50 to 250 lb. rolls. Subsequent fabric processing, including bleaching and dyeing require larger continuous quantities of fabric for efficient handling. In order to achieve longer continuous quantities of fabric, fabric from small fabric rolls were stitched together to form a continuous cloth. Problems associated with stitching smaller fabric sections together include varying product quality and properties, like inconsistent courses per inch (CPI), stretch and shrinkage, stretch and distortion of fabric wales, and lower productivity due to machine downtime for removing and loading new fabric rolls.

Additionally, prior art circular knitting machines are incapable of controlling tension at the fabric take-up roll for larger fabric roll sizes; as the fabric roll diameter increased, tension in the fabric and yarn increased, thereby causing breaks which result in increased machine downtime, higher waste, and lower fabric quality.

One prior art solution was to provide a dual roll fabric tension system between the needle sinker assembly and fabric roll. However, dual roll fabric tension systems fail to adjust for the high levels of tension generated by large fabric rolls as the diameter increases. Therefore, as the fabric tension builds-up, the fabric rips off the needles, causing machine breaks and needle damage. In addition, this system used a conventional storage feed mounting ring which required the operator to use a ladder or catwalk to attend to many of the machine functions.

Thus, there remains a need for a circular knitting machine with a tension-controlled large roll take-up assembly which can form very large continuous fabric rolls for improved quality in subsequent processing, including bleaching and finishing operations while, at the same time, permits the operator to attend to most machine functions without the need for a ladder or catwalk.

SUMMARY OF THE INVENTION

The present invention is directed to a circular knitting machine. The apparatus includes a generally conventional circular knitting element for forming a tubular knit fabric. A tension-controlled roll take-up assembly is located downstream from the circular knitting element for receiving the tubular knit fabric and forming a fabric roll from the tubular knit fabric while, at the same time, maintaining substantially constant tension on the tubular knit fabric being formed by the circular knitting element. This allows very large fabric rolls to be formed.

In the preferred embodiment, the take-up assembly includes a roll frame assembly for receiving the tubular knit fabric and forming a fabric roll from the tubular knit fabric; drive means attached to the roll frame assembly; and a tubular knit fabric tension controller located between the knitting element and the roll frame assembly for maintaining substantially constant tension on the tubular knit fabric being formed by the circular knitting element.

Also, in the preferred embodiment, the circular knitting machine includes a tension-controlled umbrella storage feed mounting ring adjacent to the circular knitting element for supplying a plurality of yarn ends to the circular knitting element for forming the tubular knitted fabric. The umbrella storage feed mounting ring permits an operator to attend to most machine functions without the need for a ladder or catwalk. In addition, the location of the tension control elements along the perimeter of the umbrella storage feed mounting ring provides an additional yarn reservoir which helps prevent fabric defects by providing additional time to stop the machine before, for example, a broken end of yarn enters the machine.

Accordingly, one aspect of the present invention is to provide a circular knitting machine. The apparatus includes: (a) a circular knitting element for forming a tubular knit fabric; and (b) a tension-controlled roll take-up assembly downstream from the circular knitting element for receiving the tubular knit fabric and forming a fabric roll from the tubular knit fabric while, at the same time, maintaining substantially constant tension on the tubular knit fabric being formed by the circular knitting element.

Another aspect of the present invention is to provide a tension-controlled roll take-up assembly for a circular knitting machine having a circular knitting element for forming a tubular knit fabric. The apparatus includes: (a) a roll frame assembly for receiving the tubular knit fabric and forming a fabric roll from the tubular knit fabric; (b) drive means attached to the roll frame assembly; and (c) a tubular knit fabric tension controller located between the knitting element and the roll frame assembly for maintaining substantially constant tension on the tubular knit fabric being formed by the circular knitting element.

Still another aspect of the present invention is to provide a circular knitting machine. The apparatus includes: (a) a circular knitting element for forming a tubular knit fabric; (b) a tension-controlled roll take-up assembly downstream from the circular knitting element for receiving the tubular knit fabric and forming a fabric roll from the tubular knit fabric while, at the same time, maintaining substantially constant tension on the tubular knit fabric being formed by the circular knitting element, the assembly including: (i) a roll frame assembly for receiving the tubular knit fabric and forming a fabric roll from the tubular knit fabric; (ii) drive means attached to the roll frame assembly; and (iii) a tubular knit fabric tension controller located between the knitting element and the roll frame assembly for maintaining substantially constant tension on the tubular knit fabric being formed by the circular knitting element; and (c) a tension-controlled umbrella storage feed mounting ring adjacent to the circular knitting element for supplying a plurality of yarn ends to the circular knitting element for forming the tubular knitted fabric.

These and other aspects of the present invention will become apparent to those skilled in the art after a reading of the following description of the preferred embodiment when considered with the drawings.

DESCRIPTION OF THE PREFERRED EMBODIMENTS

Figure 1:
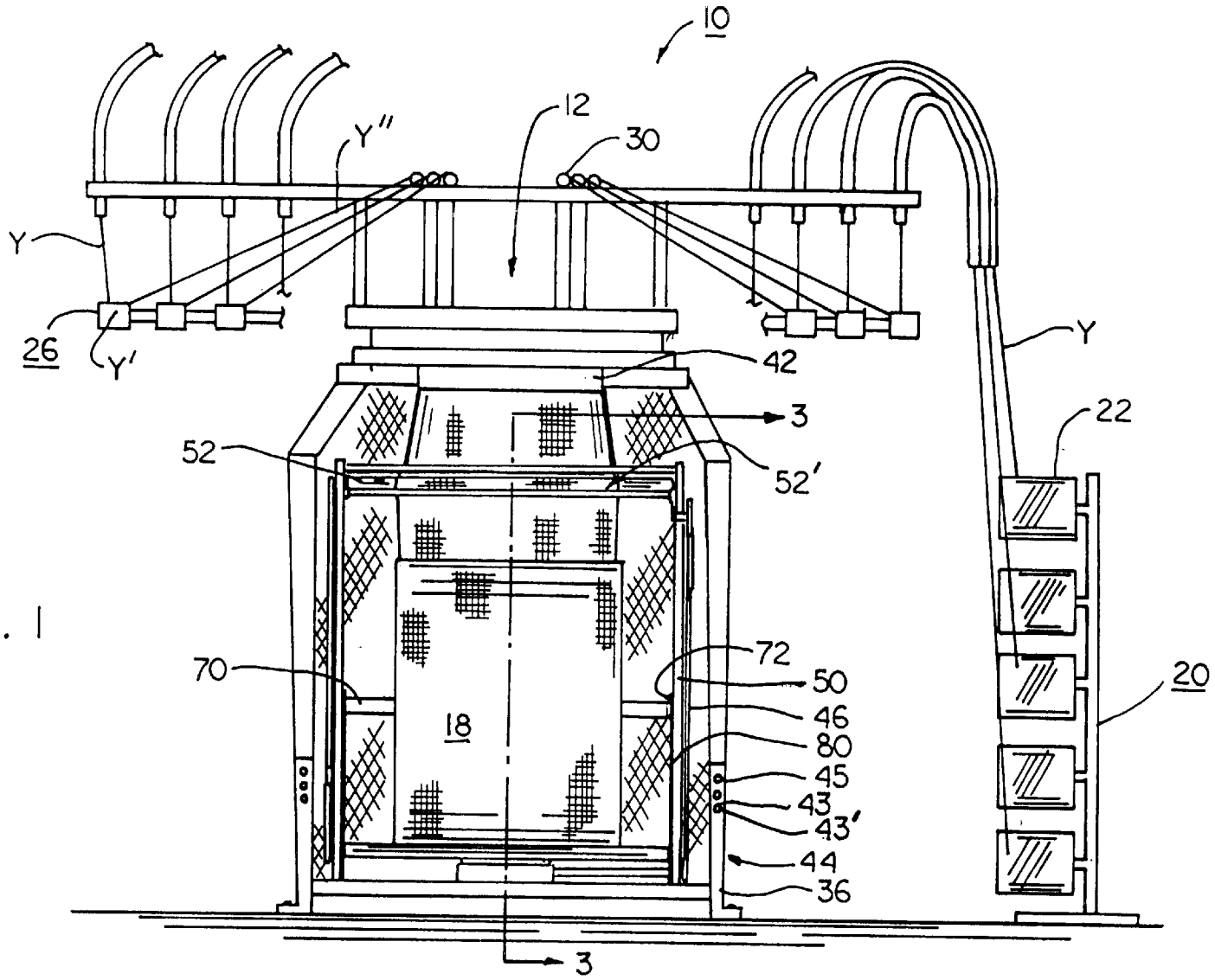
FIG. 1 is a front elevational view of a circular knitting machine constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a circular knitting machine for producing a tension-controlled large fabric roll, generally designated 10, is shown according to the present invention. A yarns Y are initially wound on a plurality of yarn packages 22 which are removably positioned on a remote creel 20.

Yarns Y are introduced to the circular knitting machine 10 from thereabove into a tension-controlled umbrella storage feed mounting ring 16 via a plurality of tension control units 26 fixedly positioned at about eye level height H at the periphery of a frame 24 which is supported by elevated legs 36. As the yarn fed into the tension control units 26, for example commercially available MEMMINGER units, the yarn forms several wraps creating a compact yarn reservoir Y' which is depleted in the event of a yarn break. The yarn Y has positive feed which is controlled by a quality wheel 86 connected in electromechanical relation with drive means 42 attached to the frame 24. The yarn forms a distance controlled yarn reservoir Y" as it passes upward through a plurality of yarn guides 30 and then downwardly into a circular knitting element 12.

The circular knitting element 12 is affixed to the frame 24 and mechanically connected with drive means 42, preferably inverter drive means which provide for deceleration and acceleration ramping to prevent tension variation and machine breaks and to reduce needle, sinker, and cam wear, in electromechanical connection with a power supply (not shown). The circular knitting element further comprises a needle sinker assembly 34 and cam ring 35, supported by a base plate 40, through which the yarns Y are transformed into a knitted fabric F.

The fabric F passes downwardly through a tension controlled large fabric roll assembly 14 comprising a roll frame assembly 50 for supporting a large fabric roll 18 which is mechanically driven by drive means 46. Additionally, the fabric F is tension-controlled as it passes over fabric tension control means 52 located between the circular knitting element 12 and a roll support frame 64 which supports the fabric roll 18, and is removably secured to the frame 24.

Figure 3:
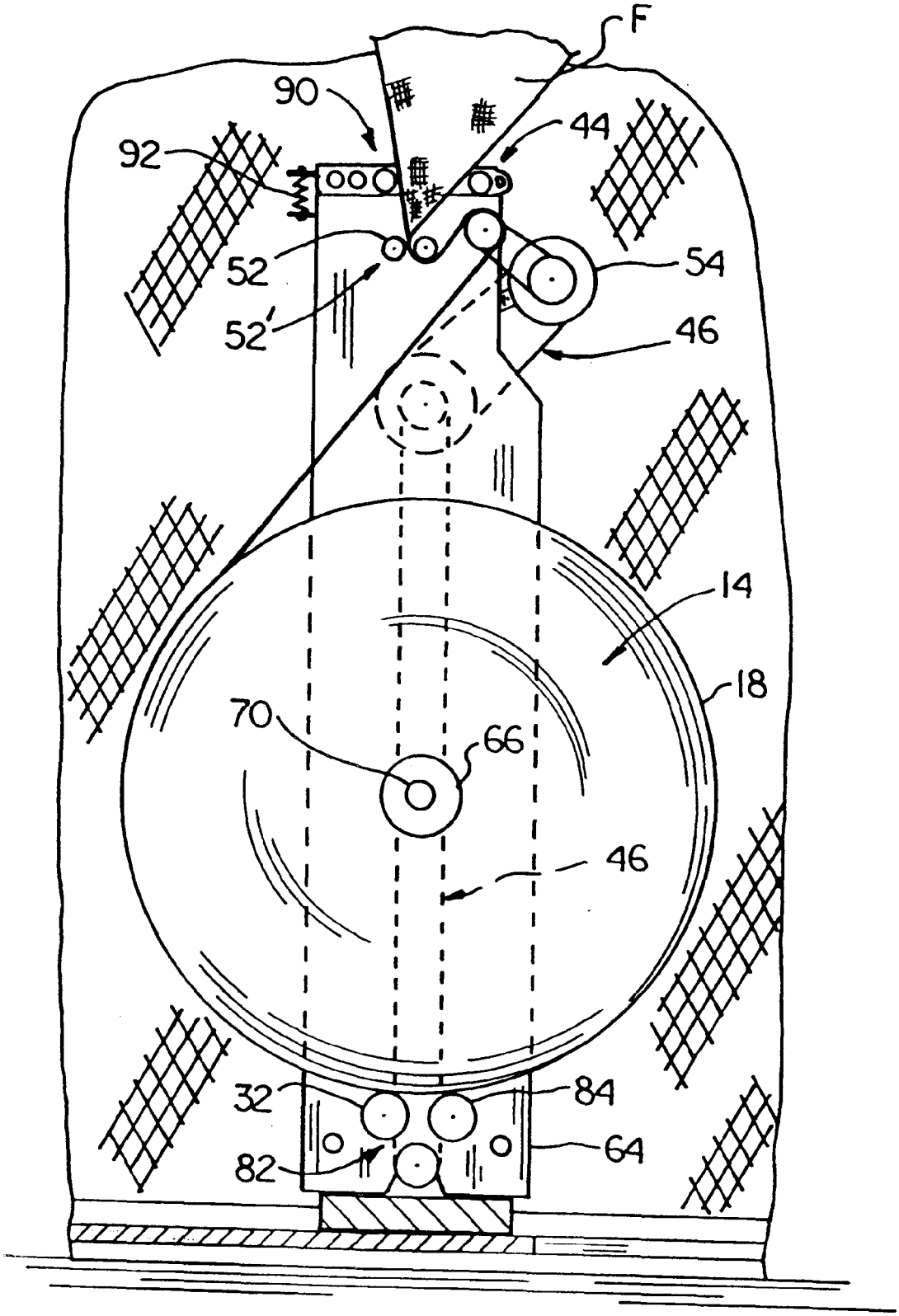
FIG. 3 is an enlarged sectional view of the tension-controlled large roll take-up assembly shown in FIG. 1, taken along lines 3—3.

In a preferred embodiment, referring now to FIG. 3, the fabric tension control means 52 comprise a plurality of parallel rollers 52, preferably at least three, over and between which the fabric F forms a wrap angle (alpha) between about 120 degrees to about 320 degrees, greater than about 180 degrees, most preferably about 300 degrees. The plurality of parallel rollers 52 are in mechanical connection to the drive means 42, and provide cantilevered motion via clutch means 54 in mechanical connection with the take-up roll 18, via chain 56 connecting support roller 60 and one of the plurality of parallel rollers 52 which are connected along a bar 90 which is affixed at one end by a spring 92 to roll support frame 64, and which reacts to the fabric F tension between the parallel rollers and the fabric take-up roll 18 which is secured within the roll support frame 64 by locking means 80, shown in FIG. 1.

Figure 2:
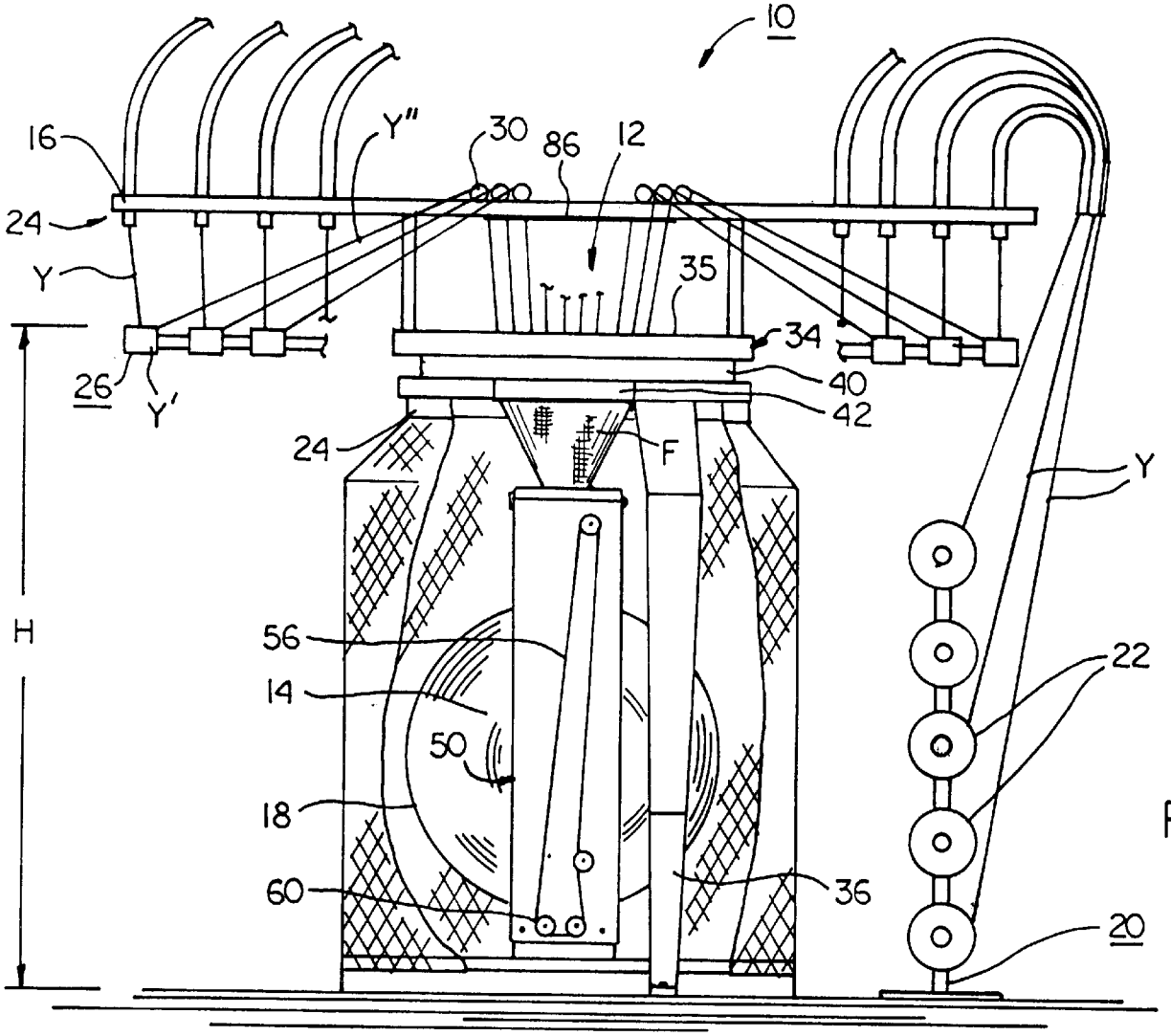
FIG. 2 is an enlarged end view of the tension-controlled large roll take-up assembly shown in FIG. 1.

Referring now to FIG. 2, the fabric roll 18 is supported on a take-up spool 66, preferably a 2" PVC tube, and driven by bottom support roller means 60, preferably a pair of rollers 82, in mechanical connection via belt 46 with drive means 42 and removably secured to the roll support frame 64, preferably with pivot bearings 84 at each end thereof, providing deflection as the fabric roll 18 increases in diameter and weight, and which also permit repair and access without necessitating disassembly of the entire machine. The take-up spool 66 is forced downwardly into frictionally driven relation with the driven support rollers 82 by biasing means 70, preferably an arbor shaft, more specifically an aluminum shaft.

The take-up spool 66 is removably slidably positioned at each end in a roll guide 72, preferably a channel or slot vertically formed within the roll frame assembly 50, thereby allowing vertical movement of the fabric roll 18 along the roll guide 72 to accommodate increasing diameter of the fabric roll 18 as fabric accumulates thereon during operation of the machine. The fabric roll frame assembly 50 is positioned concentrically underneath the circular knitting element 12 by centering system 44, preferably by aligning drilled holes 43 in the legs 36 which correspond to holes in 43' in the fabric roll frame assembly 50 and securing the alignment with removable pins 45.

Certain modifications and improvements will occur to those skilled in the art upon a reading of the foregoing description. By way of example, while in the preferred embodiment a circular knitting machine constructed according the present invention is raised above floor level by its legs, the take-up mechanism could be located in a well below floor level. It should be understood that all such modifications and improvements have been deleted herein for the sake of conciseness and readability but are properly within the scope of the following claims.

We claim:

1. A tension-controlled roll take-up assembly for a circular knitting machine having a circular knitting element for forming a tubular knit fabric, said apparatus comprising:

(a) a roll frame assembly for receiving said tubular knit fabric and forming a fabric roll from said tubular knit fabric;

(b) drive means attached to said roll frame assembly; and (c) a tubular knit fabric tension controller located between said knitting element and said roll frame assembly for maintaining substantially constant tension on the tubular knit fabric being formed by said circular knitting element; wherein said tubular knit fabric tension controller includes a plurality of cantilevered parallel rollers which move upwardly or downwardly dependent on a pre-selected level of tension on the tubular knit fabric being formed by said circular knitting element and a clutch attached to one end of one of said parallel rollers and to said drive means said clutch being operable to engage in response to upward movement of said parallel rollers, thereby maintaining said pre-selected level of tension on the tubular knit fabric being formed by said circular knitting element.

2. The apparatus according to claim 1, wherein said roll frame assembly includes a support frame, at least one powered bottom support roller for supporting and rotating said fabric roll, a take-up spool for receiving said tubular knit fabric being formed by said circular knitting element for initially forming said fabric roll, and means for biasing said take-up spool against said powered bottom support roller.

3. The apparatus according to claim 2, wherein said powered bottom support roller for supporting and rotating said fabric roll includes a second roller located parallel to said powered bottom support roller for providing additional support for said fabric roll.

4. The apparatus according to claim 2, wherein said powered bottom support roller for supporting and rotating said fabric roll is connected to said drive means.

5. The apparatus according to claim 2, wherein said powered bottom support roller for supporting and rotating said fabric roll includes a pivot bearing at each end of said roller for allowing said roller to flex under the weight of said fabric roll.

6. The apparatus according to claim 2, wherein said take-up spool for receiving said tubular knit fabric being formed by said circular knitting element for initially forming said fabric roll is a hollow tube.

7. The apparatus according to claim 2, wherein said means for biasing said take-up spool against said powered bottom support roller is an arbor shaft.

8. The apparatus according to claim 7, wherein said means for biasing said take-up spool against said powered bottom support roller includes a pair of elongated slots within said support frame for receiving the ends of said arbor shaft to permit said arbor shaft to move vertically as said fabric roll is being formed and the diameter of said fabric roll is increasing.

9. The apparatus according to claim 1, wherein said tubular knit fabric tension controller located between said knitting element and said roll frame assembly for maintaining substantially constant tension on the tubular knit fabric being formed by said circular knitting element includes at least three parallel rollers.

10. A circular knitting machine, said apparatus comprising:

(a) a circular knitting element for forming a tubular knit fabric;

(b) a tension-controlled roll take-up assembly downstream from said circular knitting element for receiving said tubular knit fabric and forming a fabric roll from said tubular knit fabric while, at the same time, maintaining substantially constant tension on the tubular knit fabric being formed by said circular knitting element, said assembly including: (i) a roll frame assembly for receiving said tubular knit fabric and forming a fabric roll from said tubular knit fabric; (ii) drive means attached to said roll frame assembly; and (iii) a tubular knit fabric tension controller located between said knitting element and said roll frame assembly for maintaining substantially constant tension on the tubular knit fabric being formed by said circular knitting element; wherein said tubular knit fabric tension controller includes a plurality of cantilevered parallel rollers which move upwardly or downwardly dependent on a pre-selected level of tension on the tubular knit fabric being formed by said circular knitting element and a clutch attached to one end of one of said parallel rollers and to said drive means, said clutch being operable to engage in response to upward movement of said parallel rollers, thereby maintaining said pre-selected level of tension on the tubular knit fabric being formed by said circular knitting element; and (c) a tension-controlled umbrella storage feed mounting ring adjacent to said circular knitting element for supplying a plurality of yarn ends to said circular knitting element for forming said tubular knitted fabric.

11. The apparatus according to claim 10, wherein said tension-controlled umbrella storage feed mounting ring includes a frame attached to said circular knitting element and a plurality of tension control elements arranged along the perimeter of said umbrella storage feed mounting ring, each of said tension control elements adapted to receive at least one of said yarn ends.

12. The apparatus according to claim 11, wherein said tension control elements adapted to receive at least one of said yarn ends are positive feed elements.

13. The apparatus according to claim 12, wherein said positive feed tension control elements adapted to receive at least one of said yarn ends are positive feed elements are driven by a single quality wheel.

14. The apparatus according to claim 11, wherein said plurality of tension control elements arranged along the perimeter of said umbrella storage feed mounting ring are positioned at about eye level.

15. The apparatus according to claim 10, wherein said tension-controlled umbrella storage feed mounting ring further includes a remote creel adjacent to said circular knitting element for positioning a plurality of yarn packages for supplying said plurality of yarn ends to said circular knitting element for forming said tubular knitted fabric.

16. The apparatus according to claim 10, wherein said circular knitting element includes a needle and sinker assembly, a base plate, a rotatable cam ring and drive means for rotating said cam ring with respect to said needle and sinker assembly for forming said tubular knitted fabric.

17. The apparatus according to claim 16, wherein said drive means for rotating said cam ring with respect to said needle and sinker assembly for forming said tubular knitted fabric is an inverter drive.

18. The apparatus according to claim 16, wherein said circular knitting element includes a plurality of legs attached to said base plate for supporting said circular knitting element.

19. The apparatus according to claim 18, wherein said plurality of legs attached to said base plate for supporting said circular knitting element are adapted to position said circular knitting element at above about eye level for providing a space beneath said circular knitting element to receive said tension-controlled roll take-up assembly.

20. The apparatus according to claim 18, wherein at least one of said plurality of legs attached to said base plate for supporting said circular knitting element include a positioning element for locating said tension-controlled roll take-up assembly with respect to said circular knitting element.

21. The apparatus according to claim 10, wherein said roll frame assembly includes a support frame, at least one powered bottom support roller for supporting and rotating said fabric roll, a take-up spool for receiving said tubular knit fabric being formed by said circular knitting element for initially forming said fabric roll, and means for biasing said take-up spool against said powered bottom support roller.

22. The apparatus according to claim 21, wherein said powered bottom support roller for supporting and rotating said fabric roll includes a second roller located parallel to said powered bottom support roller for providing additional support for said fabric roll.

23. The apparatus according to claim 21, wherein said powered bottom support roller for supporting and rotating said fabric roll is connected to said drive means.

24. The apparatus according to claim 21, wherein said powered bottom support roller for supporting and rotating said fabric roll includes a pivot bearing at each end of said roller for allowing said roller to flex under the weight of said fabric roll.

25. The apparatus according to claim 21, wherein said take-up spool for receiving said tubular knit fabric being formed by said circular knitting element for initially forming said fabric roll is a hollow tube.

26. The apparatus according to claim 21, wherein said means for biasing said take-up spool against said powered bottom support roller is an arbor shaft.

27. The apparatus according to claim 26, wherein said means for biasing said take-up spool against said powered bottom support roller includes a pair of elongated slots within said support frame for receiving the ends of said arbor shaft to permit said arbor shaft to move vertically as said fabric roll is being formed and the diameter of said fabric roll is increasing.

28. The apparatus according to claim 10, wherein said tubular knit fabric tension controller located between said knitting element and said roll frame assembly for maintaining substantially constant tension on the tubular knit fabric being formed by said circular knitting element includes at least three parallel rollers.

* * * * *